United States Patent [19]

Toy et al.

[11] 4,278,703

[45] Jul. 14, 1981

[54] METHOD AND MEANS FOR PRODUCING FLUOROCARBON FINISHES ON FIBROUS STRUCTURES

[75] Inventors: Madeline S. Toy, Palo Alto; Roger S. Stringham, Woodside; Lawrence C. Fogg, Sunnyvale, all of Calif.

[73] Assignee: Science Applications, Inc., La Jolla, Calif.

[21] Appl. No.: 68,110

[22] Filed: Aug. 20, 1979

[51] Int. Cl.[3] ..... B05D 3/06

[52] U.S. Cl. ..... 427/54.1; 204/159.22

[58] Field of Search ..... 427/54.1, 248 H; 204/159.22

[56] References Cited

U.S. PATENT DOCUMENTS

| | | | |
|---|---|---|---|
| 1,672,331 | 6/1928 | Mailey | 118/643 |
| 2,020,296 | 11/1935 | Brophy | 34/4 |
| 3,596,125 | 7/1971 | Seigel | 313/22 |
| 3,665,269 | 5/1972 | Wright et al. | 427/54.1 |
| 3,679,461 | 7/1972 | Maylotte | 427/54.1 |
| 3,686,022 | 8/1972 | White | 427/248 H |
| 3,935,359 | 1/1976 | Rowland | 156/245 |
| 4,100,418 | 7/1978 | Brown | 250/510 |
| 4,107,391 | 8/1978 | Moore et al. | 427/54.1 |
| 4,169,904 | 10/1979 | Czornyj et al. | 427/54.1 |

*Primary Examiner*—John H. Newsome

*Attorney, Agent, or Firm*—Bruno J. Verbeck; Michael L. Slonecker

[57] ABSTRACT

An improved process and apparatus is provided for imparting chemically bonded fluorocarbon finishes to textiles. In the process, the textiles are contacted with a gaseous mixture of fluoroolefins in an inert diluent gas in the presence of ultraviolet light under predetermined conditions.

8 Claims, 7 Drawing Figures

METHOD AND MEANS FOR PRODUCING FLUOROCARBON FINISHES ON FIBROUS STRUCTURES

The invention described herein was made in the performance of work under NASA Contract No. NAS 9-14827 and is subject to the provisions of Section 305 of the National Aeronautics and Space Art of 1958 (72 Stat. 435; U.S.C. 2457).

BACKGROUND OF THE INVENTION

1. Field of the Invention

The present invention relates to an improved photografting process and apparatus for imparting chemically bonded fluorocarbon finishes to textile fibers and textiles made therefrom, in which the fibrous substrate is in contact with a gaseous mixture of fluoroolefins in an inert diluent gas, and subjected to the action of ultraviolet light under predetermined conditions.

2. Brief Description of the Prior Art

It is known in the prior art that unsaturated monomeric materials can be grafted onto polymeric substrates as disclosed in such patents as U.S. Pat. No. 2,956,899 to Cline, U.S. Pat. No. 3,412,175 to Magat, et al., and U.S. Pat. No. 3,933,607 to Needles, et al. The process disclosed in the Cline patent involves irradiation of polymeric substrates in the presence of a controlled amount of oxygen, after which the activated substrate is contacted with a liquid polymerizable monomer. The Magat, et al. patent is concerned with a grafting technique which involves contacting a polymeric substrate with a fluoridated monomer in the presence of high energy radiation. As with the Cline process, the polymeric substrate has to be soaked in the liquid monomer or in a solution thereof. Needles, et al. discloses a vapor phase photografting of monomers onto polymeric substrates, requiring a two-step process in which the substrate is first treated with a wetting agent after which the substrate is contacted with a photosensitizer and with the monomer in the presence of a radiation source.

Another suggested approach has been to use a fluorocompound with a functional group that will be either adsorbed strongly to the surface or undergo a chemical reaction with the fiber surfaces. One example of this type of bonding involves the chromium complex of various acids containing long chain fluorocarbon groups:

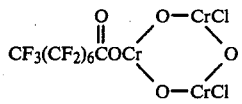

If this reaction occurs on the surface of a fiber such as nylon, the chromium will complex with amino groups, thus absorbing the fluorocarbon tail to the fiber surface. Unfortunately, such "complex" linkages will not withstand normal laundering or dry cleaning processes. *Textile Res J,* 27, 369 (1967); *Textile Res J.,* 28, 233 (1958). It has also been reported that treatment of cotton fabric with perfluoroheptene-1 or perfluorobutadiene in aqueous KOH and NaOH formed fluorocarbon grafts to cellulose. The application of fluorocarbon finishes to wool by plasma polymerization has also been reported. *Textile Res J.,* 42, 307 (1972); *Sci.-Chem.,* A10 (3), 579 (1976).

The textile industry has tried many finishes to improve the surface property of e.g., polyester fibers but its smooth and chemically passive nature makes it extremely difficult to retain any finish on the surface. Some soilrelease schemes have been developed for polyester/cotton blends by an electrical discharge method, but a noticeable stiffening of the "hand" of the material was noted. *Textile Res J.,* 42, 307 (1972).

It is also known in the art to treat aromatic polyamides to impart thereto flame-proofing properties by subjecting aromatic polyamides to fluorocarbon treatment to irreversibly modify the polyamides with fluorocarbon grafts. J. Appl. Polymer Sci., 21, 2538 (1977). The known method is, however, not entirely satisfactory, requiring an undesirably long time to effect effective fluorocarbon grafting.

SUMMARY OF THE INVENTION

It is an object of this invention to produce fluorocarbon finishes on fibrous structures such as textiles by means of an improved process in one step, under dry conditions, without the need of drying or curing the treated products, and with no chemical by-products which have to be washed out of the finished products.

Another object of the invention is to provide an improved process for imparting fluorocarbon finishes to commercial woven fabrics to improve non-flammability and chemical resistance without altering the fabric's physical properties or imparting skin irritants and allergenicity to the fabrics.

Still another object of the invention is to provide an improved process for upgrading water repellency, soiling, staining, and abrasive resistances to fibrous products such as textiles without altering the appearance, or imparting a stiffening to the treated products.

A still further object is to provide a new and unique apparatus useful in producing fluorocarbon finishes on fibrous structures such as fabrics.

In accordance with the above-stated objects, our novel process comprises a one-step fluorocarbon-grafting procedure on the fibrous products in the presence of fluoroolefins, a diluent inert gas, and ultraviolet light under predetermined conditions. The photografting processor, in one form, comprises a cylindrical vacuum-assisted chamber containing a quartz sleeve and an ultraviolet lamp therein, surrounded by a quartz cooling jacket. The ultraviolet source has an output of about 9,000 to 10,000 watts at 200 watts per inch.

The fluorocarbon grafting process irreversibly modifies the fibrous product surface and upgrades its nonflammability, water repellency, chemical inertness, soiling, staining, and abrasive resistance properties. In addition, the fabric becomes soft and silky. Generally, the reaction temperature is between ambient to about 200° C. depending upon the low to high temperature properties of the fibrous products, and their exposure times.

Other features and advantages of our invention will become apparent from the following detailed description of the preferred embodiments, as considered in conjunction with the accompanying drawings.

BRIEF DESCRIPTION OF THE DRAWINGS

Referring to FIG. 1, the apparatus comprises an aluminum cylindrical vacuum chamber 11, flanged as shown, and adapted to receive a cover plate 12 which is secured to chamber 11 in an airtight manner by bolts 13. Projecting through the cover plate 12 is outer quartz tube 14. Aluminum vacuum seal 15 equipped with a Viton O-ring provides an airtight connection between quartz tube 14 and cover plate 12. Positioned within outer quartz tube 14 is a quartz cooling jacket 16 (FIG. 3) having inlet end portions 17, 18 and 18*a*, and corresponding outlet end portions (not shown) for the ingress and egress, respectively, of cooling fluid. Mercury lamp 19 is held in place by a quartz lamp support tube 21 carrying spacer lugs 31 at its upper and lower ends (see FIGS. 2, 3 and 5), also formed preferably of quartz. The presently preferred ultraviolet lamp used is 122 cm. in length, has an outside diameter of 20 mm. and an output of about 9750 watts. As shown in the drawing, the outer diameter of the quartz sleeve 14 is about five times that of lamp 19, so that the spacing between the outer surface of lamp 19 and the outer surface of sleeve 14 is about 40 mm. The temperature parameters of the ultraviolet lamp 19 are set out in FIG. 7. Through nitrogen inlet tube 32, nitrogen gas passes down and around lamp 19 and into the atmosphere through an outlet tube (not shown) to maintain an inert gaseous environment for lamp 19. Feed rollers 22 and 23 are journaled for rotation in cover plate 12, and correspondingly in the bottom of cylinder 11 (not shown). Feed spool 24 and take up spool 25 are, each of them, journaled for rotation on the bottom end portion (not shown) of chamber 11 and project through the cover plate 12, through suitable seals, as at 26 in FIG. 2, which permit rotation of the feed and take up rollers. The seals 26 are of course, air tight. A bushing carrier plate 27 is positioned as shown. The fabric being treated according to the process of the invention is shown in FIGS. 1, 2, 3 and 5 as web 28. A valve 28*a* is provided to permit evacuation of chamber 11, and a similar valve 29 is connected to a source of the treating gas with which chamber 11 is flooded.

FIG. 4 shows the relative spectral radiance of the ultraviolet lamp 19 between 220 and 580 nm. for optimum processing conditions. An appropriate filtering solution for lamp 19 is desirable to reduce the heat generated during operation. The filtering solution should circulate through the quartz cooling jacket 16 surrounding the lamp, and should preferably absorb the total infrared and visible range with transparency (less than 300 nm.) in the ultraviolet region.

As shown in FIGS. 1, 2, 3, and 5, the web 28 extends circumferentially around and in contact with the outer surface of quartz sleeve 14 for about 240°. The portion of the outer surface of tube 14 not contacted by web 28 is overlaid with a layer 30 of ultraviolet radiation impervious material which in the illustrated apparatus takes the form of a longitudinally extending layer of Sauereisen No. 33 coat (Sauereisen Cement Company, Pittsburg, Pa.) painted on tube 14. The Sauereisen coat shields the light through that area. Otherwise, the shining light may possibly cause some cyclization and polymerization of the monomers in the apparatus. Sauereisen, which is a porcelain like coating commonly used as an electrical insulator adheres to quartz, withstands high temperature (up to 2,000° F.), and functions extremely well.

FIG. 6 shows a schematic diagram of the cooling system used in connection with the apparatus for practicing our invention.

Figure 1:
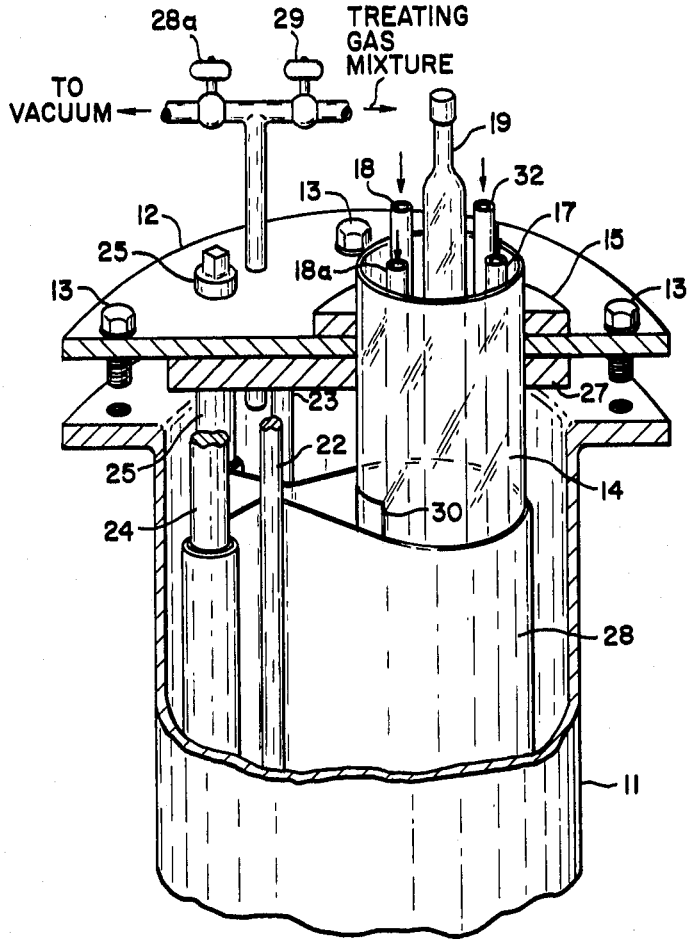
FIG. 1 is a fragmentary exploded view in perspective, and partly broken away, of apparatus for carrying out the process of the invention.

Illustrated therein is a coolant tank 33 containing a cooling liquid 38, such as circulating cooling water. A supply tank 34 contains liquid coolant 42 which is supplied to the jacket 16 through a tube 41 having a pump 35 interposed therein. A by-pass valve 36 is connected to the tube 41 on the outlet side of pump 35, the output side of valve 36 having a tube 43 connected thereto for return of fluid 42 to tank 34 when said valve is opened. A cooling coil 37 is disposed in the coolant 38 in tank 33 as shown and has one end thereof connected to the outlet of jacket 16 through tube 39, the opposite end of the coil 37 being connected to a tube 40 for return of cooled fluid 42 to tank 34 as shown.

In order to increase the cooling capacity of the circulating fluid 42 which passes through the quartz jacket 16 around the ultraviolet lamp 19, aqueous solutions of iodine, copper sulfate, nickel sulfate, acetic acid, cobalt sulfate, and some combinations thereof were screened at concentrations between 2.5 grams to 40 grams in 50 gallons of water in the filter tank. Although the cooling capacity had increased in maintaining the desirable temperature range about 150°-200° C. for a few hours, the efficiency of the process was decreased due to the ultraviolet adsorption property of the aqueous solutions.

We have found that Freon TF (i.e., Freon 113 or Trichlorotrifluoroethane) functioned as a better coolant than either water or aqueous solutions. Freon TF is commonly used as an industrial cleaning solvent, is non-flammable, non-explosive, exceptionally pure (i.e., 99.8 Trichlorotrifluoroethane with not more than 0.2% of other stable chlorofluorocarbons), is low in toxicity, and is commercially available in large quantities. Its property of being transparent in the ultraviolet region, and adsorbing in the infrared serve the purpose of lowering the outer quartz tube temperature without decreasing the efficiency of the process. A further advantage stemming from using Freon TF is the unique cleaning properties of this material in eliminating or minimizing the formation of deposits in the quartz cooling jacket 16, and allowing substantial, i.e., 40%, ultraviolet transmission.

Figure 3:
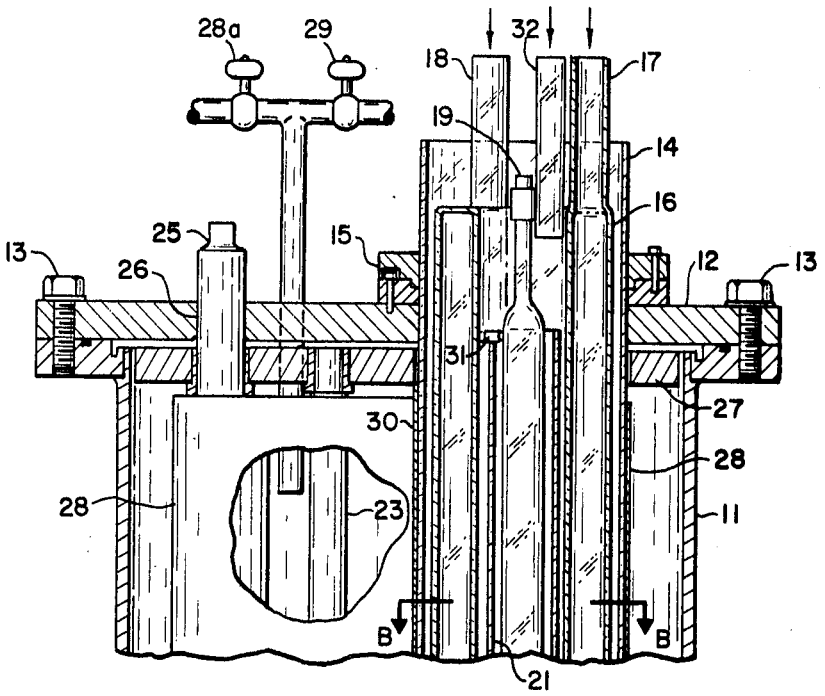
FIG. 3 is a vertical sectional view taken along the line A—A of FIG. 2.
Figure 2:
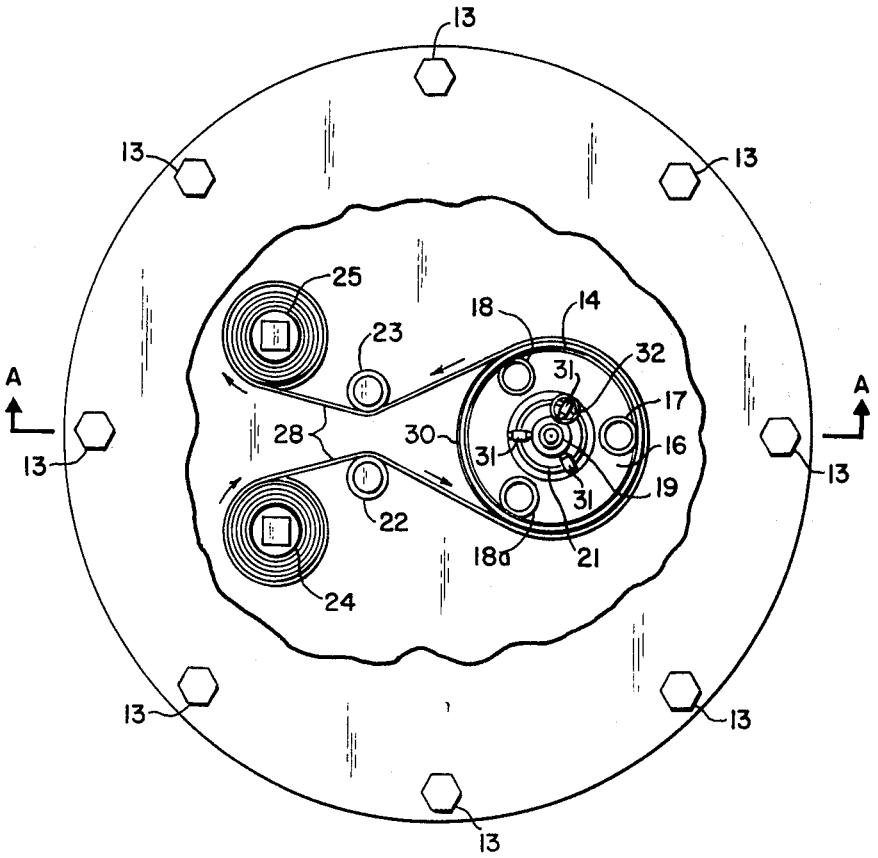
FIG. 2 is a plan view of the apparatus of FIG. 1 with a portion of the upper end plate and bushing carrier broken away.
Figure 4:
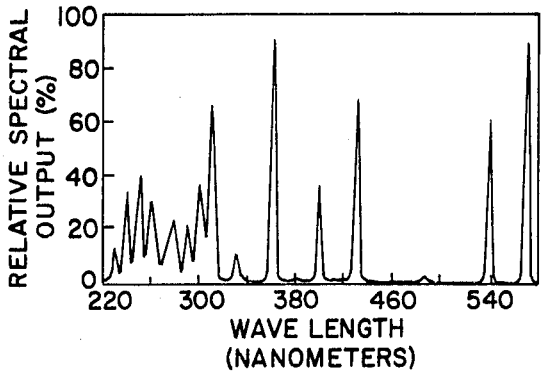
FIG. 4 is a graph illustrating the relative spectral output at the various wavelengths produced by the ultraviolet lamp used in the apparatus.
Figure 5:
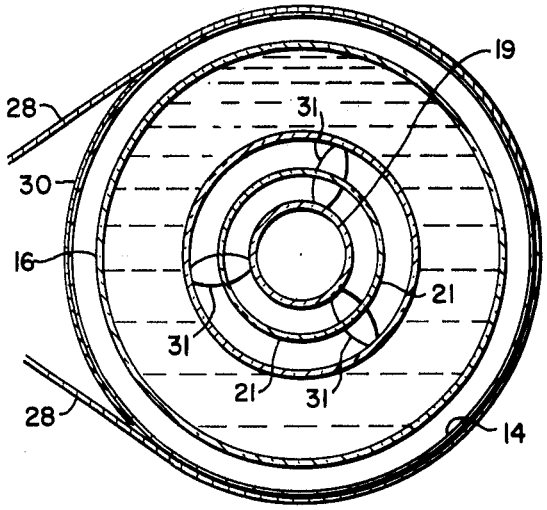
FIG. 5 is a horizontal sectional view on an enlarged scale taken along the line B—B of FIG. 3.
Figure 6:
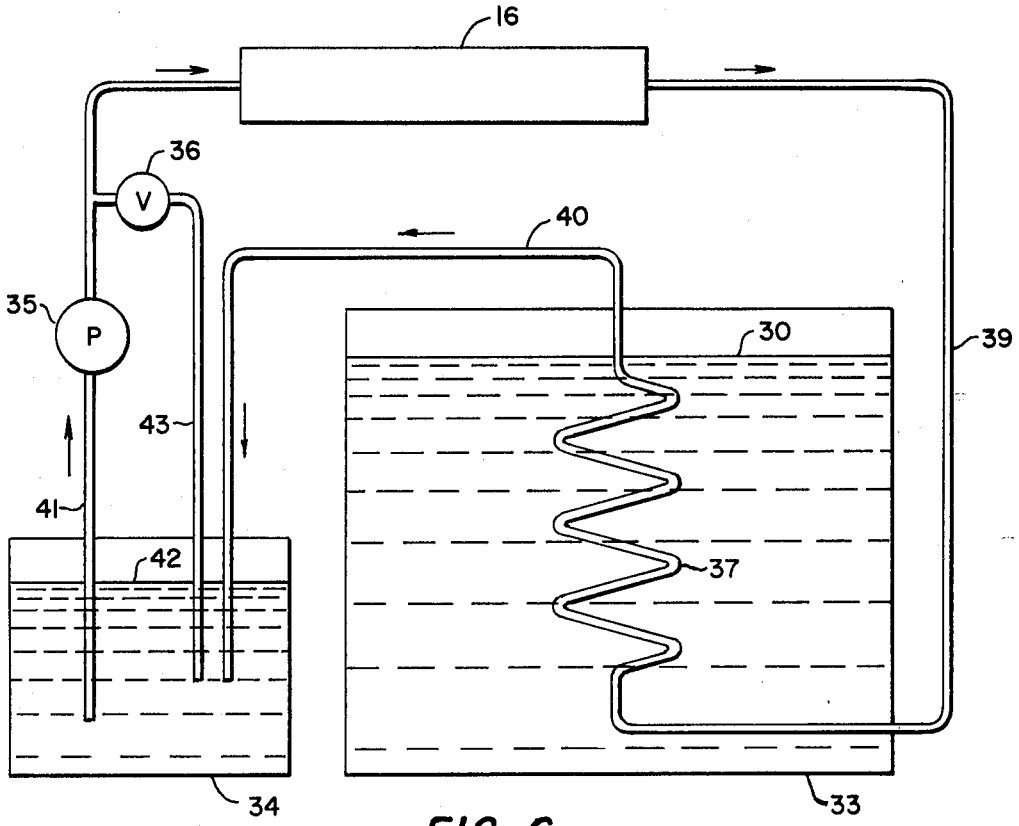
FIG. 6 is a schematic diagram of the cooling system used in connection with the apparatus shown in the preceding drawings.
Figure 7:
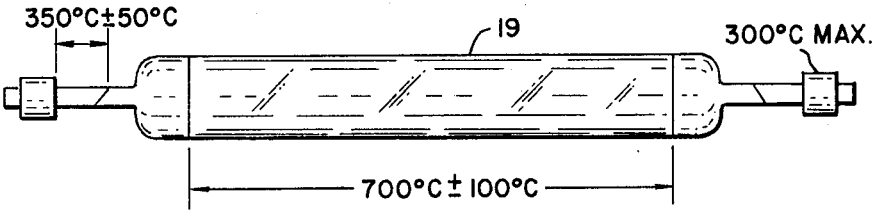
FIG. 7 is a side elevational view of the ultraviolet lamp used in the apparatus, showing the temperature parameters along the length thereof.

In carrying out our process, web 28 of fabric to be treated is rolled onto feed roller 24 and threaded around spacer roller 22, thence around outer quartz tube 14, around spacer 23, and onto take-up roller 25. With the cover plate 12 bolted in an airtight manner to chamber 11, chamber 11 is evacuated and there is fed thereinto a gas mixture comprising 1% tetrafluoroethylene, 4% bromotrifluoroethylene, and 95% nitrogen. With the lamp 19 in operation, cooling fluid at a temperature of about 21° C. passing through cooling jacket 16, and nitrogen gas passing through inlet 32, take-up roller 25, which is connected to a motor, (not shown) is set in motion and the fabric is moved around outer quartz tube 14 in the direction shown by the arrows in FIG. 3. A web 28 of polyester fabric, was treated in the apparatus during an exposure time of between about 200 to 500 seconds at the illustrated lamp-to-fabric distance of about 40 mm. This resulted in the fabric becoming irreversibly modified with fluorocarbon grafts, and non-wettable with water droplets. It will be understood that the fluoroolefin mixtures may vary from neat bromotrifluoroethylene to equal ratios of bromotrifluoroethylene to tetrafluoroethylene in the presence of 90 to 95% nitrogen. However, the drawback in using a neat bromotrifluoroethylene with nitrogen is that coloration is imparted to the treated fabric, and additionally, there is undesirable interaction with any stainless steel parts of the apparatus. We found that the addition of a few percent of tetrafluoroethylene in the gaseous mixture decreased the treated fabric coloration to almost nil, and halted any visible interaction with the stainless steel parts inside the equipment.

The presently preferred composition of the gaseous mixture used in treating the textiles in accordance with the present invention comprises 1% tetrafluoroethylene, 4% bromotrifluoroethylene, and 95% nitrogen.

In another example of our invention, commercial width polyester fabric treated in the illustrated apparatus was photografted in the presence of a gaseous mixture of 1% tetrafluoroethylene, 4% bromotrifluoroethylene, and 95% nitrogen with two different exposure times, namely at 200 and 500 seconds. The treated polyester fabrics became irreversibly modified with fluorocarbon grafts, and were found to be non-wettable with water droplets. While there was some fabric coloration observed at a 500 second exposure time, there was almost none for exposure at 200 seconds.

Our invention is broadly applicable to treatment of a wide variety of natural and synthetic organic fibers, and mixed blends, including cottons, polyester, cotton-polyester blends, wool-polyester blends, polyamides, and the like, and results in the treated fibrous structures having improved water-repellency, softness, silkiness, and improved flame and chemical resistance.

While we have shown and described preferred embodiments of our invention, it will be appreciated that various changes, rearrangements and modifications may be made therein without departing from the spirit and scope of the invention as defined in the appended claims, and to the extent that variant forms of our invention are possible said forms are considered to be within the scope and essence of our invention.

What is claimed is:

1. A method for imparting an improved finish to a fibrous textile material or the like while retaining the identity of the material, comprising contacting a web of said material with a gaseous medium containing from about 5% to about 10% of a fluoroolefin gas comprising bromotrifluoroethylene as its major component and from about 90% to about 95% of an inert diluent gas, and while so contacted, subjecting said web to ultraviolet radiation under controlled conditions by moving the latter from a supply roll thereof along a cylindrical path toward a takeup roll therefor, said cylindrical path being spaced about 40 mm from an elongated ultraviolet lamp located substantially at the axis of said path and having an output of about 200 watts per inch of length, and maintaining the temperature of said web within the range of about ambient to about 200° C., said web movement being such as to expose said web to ultraviolet radiation from said lamp for from about 200 to about 500 seconds during traversal of said cylindrical path by said web, thereby to cause photografting and chemical bonding between the fluoroolefin in said gaseous medium and the fibers of said material effective to impart said improved finish to said material.

2. The method of claim 1 wherein said cylindrical path is defined by the outer surface of a cylindrical ultraviolet transmissive sleeve coaxially surrounding said lamp and overlaid by said web around a major portion of the circumference thereof.

3. The method of claim 1 wherein the temperature of said web is maintained within said range by passing the light from said lamp through an ultraviolet transmissive jacket in spaced surrounding relation with respect to said lamp and containing trichlorotrifluoroethane to remove the infrared portions from said light prior to contact of the latter with said web.

4. The method of claim 1 wherein during irradiation of said web, the exterior of said lamp is flushed with nitrogen gas which is prevented from contacting said web.

5. The method of claim 1 wherein the temperature of said web is maintained between about 150° C. and 200° C.

6. The method of claim 1 wherein said inert diluent gas is nitrogen and said fluoroolefin gas ranges from neat bromotrifluoroethylene to equal amounts of bromotrifluoroethylene and tetrafluoroethylene.

7. The method of claim 1 wherein said gaseous medium comprises about 1% tetrafluoroethylene, about 4% bromotrifluoroethylene and about 95% nitrogen.

8. The method of claim 1 wherein said textile material comprises fibres formed of one or more of the group consisting of cotton, wool, polyester and polyamide.

* * * * *